US006488772B2

(12) United States Patent
Falck et al.

(10) Patent No.: US 6,488,772 B2
(45) Date of Patent: Dec. 3, 2002

(54) DISPENSER UNIT FOR A COATING APPARATUS

(75) Inventors: Michael Falck, Wanatah, IN (US); Norbert Satkoski, Union Mills, IN (US)

(73) Assignee: Roll Carter, Inc., Greenfield, IN (US)

( * ) Notice: Subject to any disclaimer, the term of this patent is extended or adjusted under 35 U.S.C. 154(b) by 91 days.

(21) Appl. No.: 09/784,830

(22) Filed: Feb. 16, 2001

(65) Prior Publication Data

US 2001/0029887 A1 Oct. 18, 2001

Related U.S. Application Data

(60) Provisional application No. 60/183,065, filed on Feb. 16, 2000.

(51) Int. Cl.[7] ..... B05C 1/06

(52) U.S. Cl. ..... 118/264; 118/266; 184/102

(58) Field of Search ..... 118/264, 266; 427/429; 184/102

(56) References Cited

U.S. PATENT DOCUMENTS

| | | | | |
|---|---|---|---|---|
| 3,877,414 A | 4/1975 | Brideau et al. | ..... | 118/234 |
| 4,055,971 A | 11/1977 | Hermes | ..... | 68/9 |
| 4,604,300 A | 8/1986 | Keys et al. | ..... | 427/429 |
| 5,414,912 A | 5/1995 | Nielsen et al. | ..... | 26/15 L |
| 5,549,752 A | 8/1996 | Hahn et al. | ..... | 118/234 |
| 5,985,028 A | 11/1999 | Cornell et al. | ..... | 118/264 |
| 6,013,312 A | 1/2000 | Cornell et al. | ..... | 427/210 |
| 6,105,725 A | 8/2000 | Williams | ..... | 184/102 |

*Primary Examiner*—Laura Edwards
(74) *Attorney, Agent, or Firm*—Barnes & Thornburg

(57) ABSTRACT

A coater for applying coating material to a moving strip of metal or other substrate. The coater comprises at least one dispenser unit and preferably a pair of dispenser units disposed about the moving strip of substrate. Each dispenser unit is adapted to be in communication with a supply of coating material and to apply coating material to a side of the moving strip. Each dispenser unit comprises a receptacle, a coating discharger strip received within the receptacle having an applicator surface for applying coating material to the respective side of the moving strip, a retainer member received within the receptacle for securing the discharge strip within the receptacle, and an anti-wicking member associated with the retainer member for hindering wicking of coating material away from the applicator surface of the coating discharger strip. Each dispenser unit desirably also includes at least one adjustable retainer stem associated with a respective retainer member for adjustably positioning the respective retainer member within a respective receptacle to secure the coating discharger strip to the receptacle for applying coating material to the respective side of the strip.

25 Claims, 11 Drawing Sheets

DISPENSER UNIT FOR A COATING APPARATUS

This application claims the benefit of priority of U.S. provisional patent application Ser. No. 60/183,065, filed on Feb. 16, 2000.

BACKGROUND AND SUMMARY OF THE INVENTION

The present invention relates to a coating apparatus, and more particularly to an apparatus for applying coating material to a strip of metal or other substrate. More particularly, the present invention relates to a dispenser unit for a coater apparatus for applying liquid coating material to a strip of metal or other substrate.

Coating apparatus are disclosed in U.S. Pat. Nos. 4,604,300, 5,549,752, 5,985,028, and 6,013,312. These references are hereby incorporated by reference herein.

Currently, numerous methods exist for applying a coating or thin film of material to a strip of metal or other material. One conventional method of coating a continuous strip of substrates to submerse the strip in a bath of the coating material. This can be accomplished by pulling the substrate through the bath of coating material, and then wiping off any excess coating material. This method has many drawbacks. One drawback to this method is the difficulty to control the amount of coating material applied to each side of the strip. Another drawback is the inability to apply different coating materials to each side of the strip. Also, this method often wastes a certain amount of the coating material during the wiping step.

Another known method of applying a coating or thin film of material to a strip of substrate is to employ a spray coater or atomizer. In such a method, the coating material is electrostatically disposed on the strip. A spray coater in accordance with this method is disclosed in U.S. Pat. No. 4,839,202.

Other known types of coating methods include passing the strip of substrate through various applicators which deposit a thin film onto the strip with or without electrostatic assistance. The applicators can be either stationary members or rotable members. One example of such a coating apparatus, which uses a pair of oppositely-disposed applicators, is disclosed in U.S. Pat. No. 5,549,752 to Hahn et al. The Hahn patent discloses passing a continuous strip of material between a pair of oppositely disposed applicators for applying a thin film thereto. In one embodiment, two stationary wicks directly contact the sides of the continuous strip of material to apply a coating to both sides of the sheet material. In another embodiment, the wicks apply the coating material to two feed rolls which contact the sides of the strip to apply a thin film of coating material thereto. One drawback to this type of coating apparatus is that it lacks the ability to adjust the amount of coating material being supplied to various sections of the applicators.

Other examples of prior coating apparatuses and methods are disclosed in U.S. Pat. Nos.: 5,985,028 to Cornell et al.; 4,601,918 to Zaman et al; 4,604,300 to Keys et al.; 4,712,507 to Helling; and 4,995,934 to Janatka.

There is a need to provide a coating apparatus that increases efficiency and reduces waste. Accordingly, it is an object of the present invention to provide a coater for a coater apparatus that includes a dispenser unit having a coating discharger strip for dispensing coating material that can be replaced quickly and easily. It is a further object of the present invention to provide such a coater wherein the dispenser unit includes an anti-wicking member for increasing efficiency and decreasing waste.

In accordance with these and other objects, the present invention provides a coater for applying coating material to a moving strip of metal or other substrate. The coater comprises at least one dispenser unit, and preferably a pair of dispenser units disposed about the moving strip of substrate. Each dispenser unit is adapted to be in communication with a supply of coating material and to apply coating material to a side of the moving strip. Each dispenser unit comprises a receptacle, a coating discharger strip received within the receptacle having an applicator surface for applying coating material to the respective side of the moving strip, a retainer member received within the receptacle for securing the discharge strip within the receptacle, and an anti-wicking member associated with the retainer member for hindering wicking of coating material away from the applicator surface of the coating discharger strip. Each dispenser unit desirably also includes at least one adjustable element associated with the retainer member for adjustably positioning the retainer member within the receptacle to secure the coating discharger strip to the receptacle for applying coating material to the side of the strip.

Other objects, advantages and novel features of the present invention will become apparent from the following detail description of the drawings when considered in conjunction with the accompanying drawings.

DETAILED DESCRIPTION OF THE DRAWINGS

Figure 1:
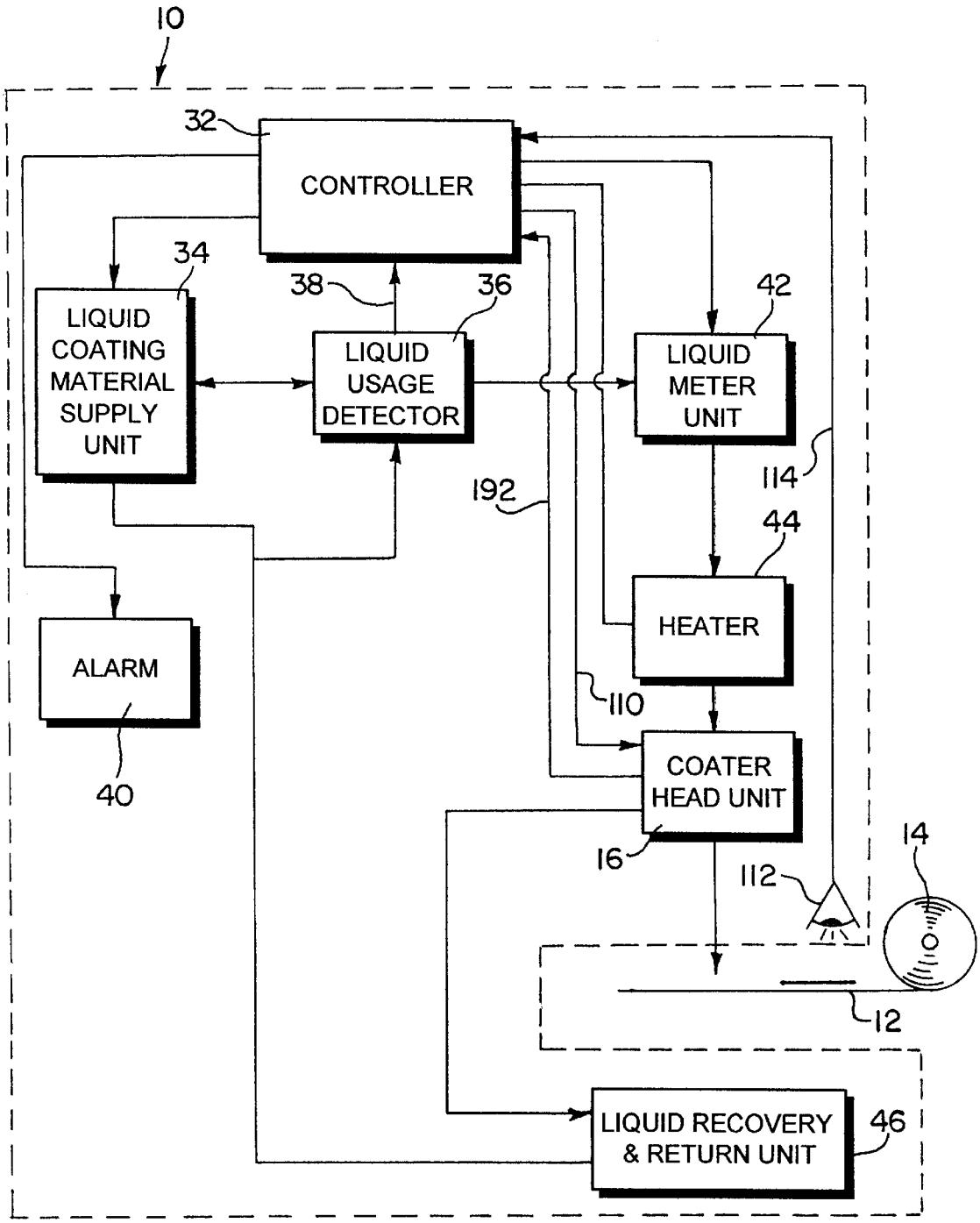
FIG. 1 is a diagrammatic view of a metal strip coating apparatus configured to apply a metered amount of a liquid coating material to a moving metal strip using a coater head unit.

A strip coating apparatus 10 is configured to apply a metered amount of liquid coating material to a moving strip 12 of metal or other substrate provided by a strip supply 14, as shown, for example, in FIG. 1. The illustrated coating apparatus 10 includes a coater in the form of a coater head unit 16 which includes front and rear coaters in the form of coater heads 18, 20 configured to shuttle into and out of the production line of moving metal strip 12, as shown, for example, in FIGS. 2–4. Each of front and rear coater heads 18, 20 includes upper and lower dispenser units 22, 24 which are configured to dispense liquid coating material for direct application onto moving metal strip 12 each using a strip of coating material discharger 26, as shown, for example, in FIGS. 2–4 and 5–6. The strip of the coating discharger 26 desirably may be constructed of felt or any other suitable material and may have any suitable configuration.

Each of front and rear coater heads 18, 20 is configured to move felt coating dischargers 26 of upper and lower dispenser units 22, 24 between a closed position and an opened position. In the closed position, felt coating discharger 26 of upper dispenser unit 22 contacts an upper surface 28 of moving metal strip 12 and felt coating discharger 26 of lower dispenser unit 24 contacts a lower surface 30 of moving metal strip 12, as shown, for example, in FIGS. 4 and 6. In the opened position, felt coating dischargers 26 of upper and lower dispenser units 22, 24 are positioned to lie in spaced apart relation to upper and lower surfaces 28, 30, respectively, of moving metal strip 12, as shown, for example, in FIG. 7.

Coating apparatus 10 further includes a controller 32, a liquid coating material supply unit 34, and a liquid usage detector 36, as shown, for example, in FIG. 1. Controller 32 is configured to control the application of liquid coating material onto moving metal strip 12. In preferred embodiments, controller 32 is a programmable logic controller supplied by Rockwell Automation located in Milwaukee, Wis. Liquid supply unit 34 is coupled to controller 32 and includes a heater (not shown) and a transfer pump (not shown) to supply heated liquid coating material directly to liquid usage detector 36 in an intermittent fashion for ultimate application to moving metal strip 12.

Liquid usage detector 36 is configured to detect the actual volumetric flow rate of liquid coating material flowing through coating apparatus 10. Liquid usage detector 36 is further configured to provide a variable, analog signal 38 indicative of the actual volumetric flow rate to controller 32 so that controller 32 can perform closed-loop feedback control of coating apparatus 10. Coating apparatus 10 can include an alarm 40 coupled to controller 32 and configured to alert an operator when the actual volumetric flow rate is outside of a predetermined range.

Coating apparatus 10 further includes a liquid meter unit 42, an inline heater 44, and a liquid recovery and return unit 46, as shown, for example, in FIG. 1. Liquid meter unit 42 receives liquid coating material from liquid usage detector 36, is coupled to controller 32, and is configured to meter the amount of liquid coating material provided to coater head unit 16. Between liquid meter unit 42 and coater head unit 16, liquid coating material flows through inline heater 44 which is coupled to controller 32 and is configured to heat liquid coating material (in addition to the heating provided by supply unit 34) to a predetermined temperature to facilitate "flash drying" of liquid coating material when it is applied to moving metal strip 12. Liquid recovery and return unit 46 is configured to limit wastage of liquid coating material by recycling excess liquid coating material. Liquid recovery and return unit 46 recovers excess liquid coating material from coater head unit 16 and returns the excess to liquid usage detector 36 during operation of coating apparatus 10 and liquid supply unit 34 during purging and cleaning of coating apparatus 10.

Figure 10:
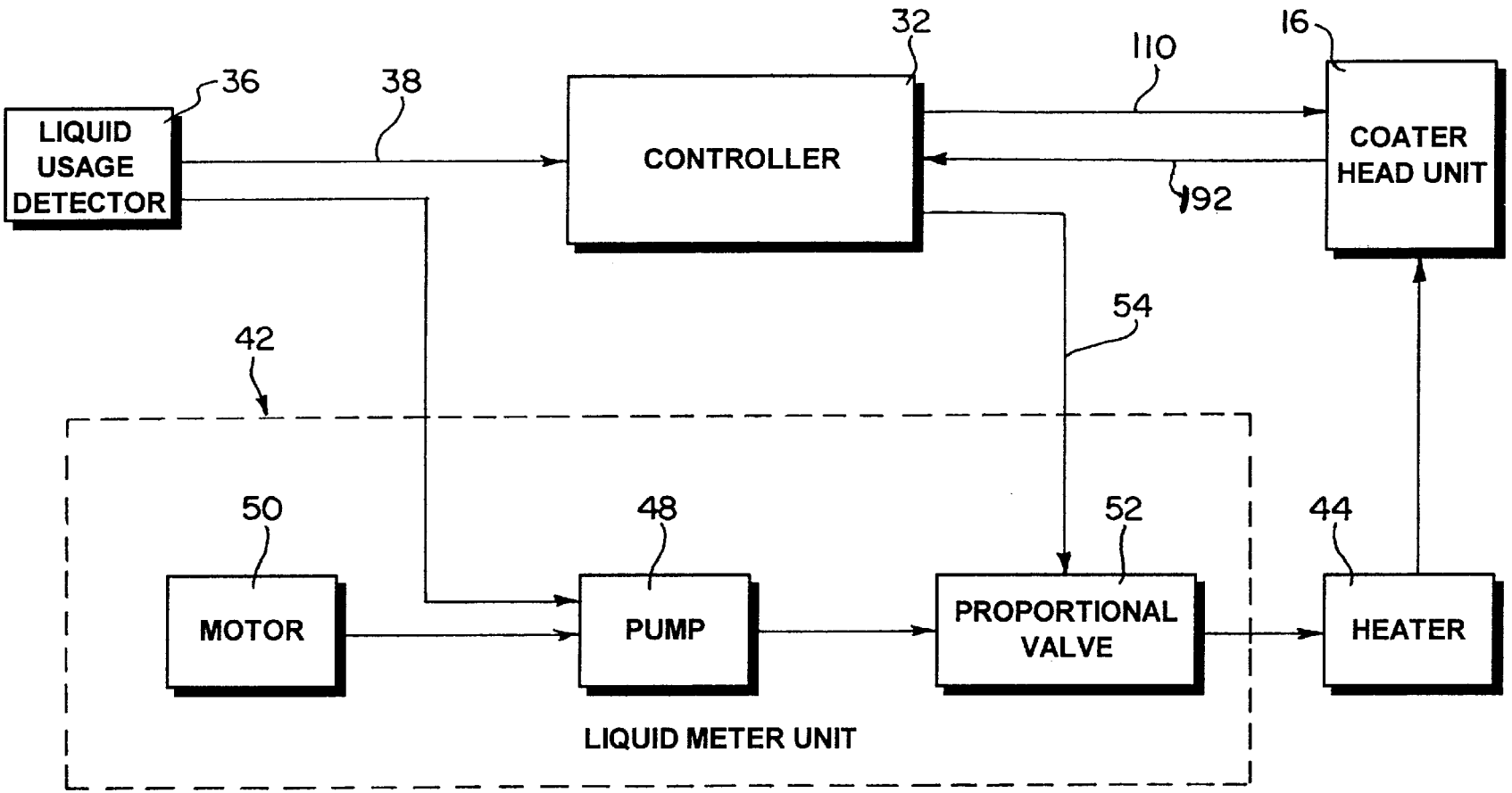
FIG. 10 is a diagrammatic view of the liquid meter unit of FIG. 1 showing the liquid meter unit including a pump configured to deliver liquid coating material to the coater head unit, a motor coupled to the pump to drive the pump, and a proportional valve coupled to the controller and the pump to regulate the volume of liquid coating material delivered to the moving metal strip.

Liquid meter unit 42 includes a centrifugal pump 48, a motor 50 coupled to centrifugal pump 48 to drive centrifugal pump 48, and a proportional valve 52 coupled to controller 32 and centrifugal pump 48 for fluid communication with centrifugal pump 48, as shown, for example, in FIG. 10. Centrifugal pump 48 is sized to operate at the upper end of its performance curve to deliver liquid coating material to coater head unit 16 from liquid usage detector 36 at a constant pressure regardless of fluctuations in the demand for liquid coating material due, for example, to width changes in moving metal strip 12. Using single centrifugal pump 48 limits equipment and installation cost of coating apparatus 10, the complexity of coating apparatus 10, the amount of piping necessary for coating apparatus 10, the cost to maintain coating apparatus 10, and the potential for leaks of liquid coating material. Proportional valve 52 regulates the volume of liquid coating material delivered to moving metal strip 12 based on a signal 54 from controller 32.

Figure 11:
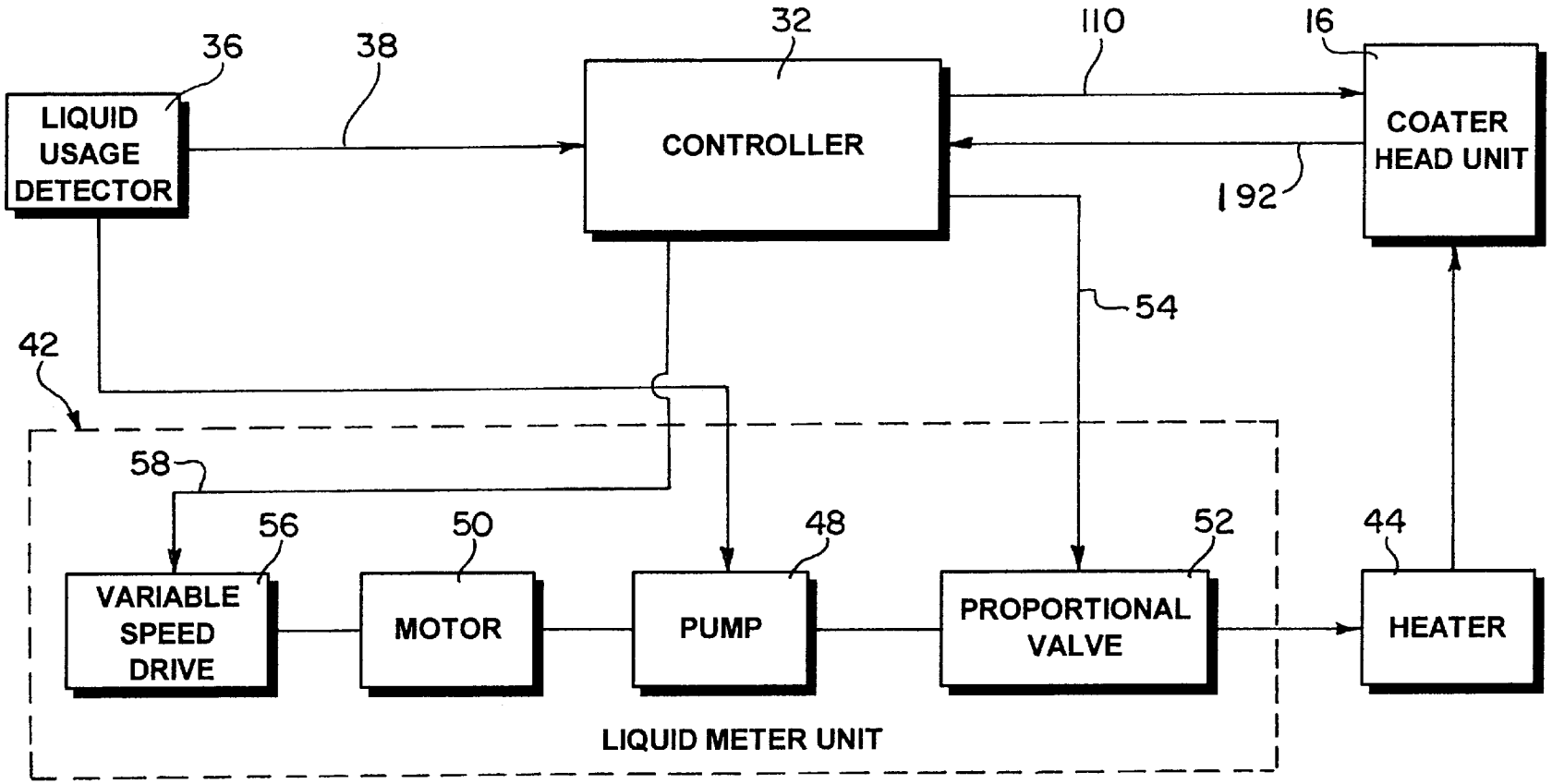
FIG. 11 is a diagrammatic view of an alternative embodiment of the liquid meter unit of FIG. 1 showing the liquid meter unit including the pump, the motor, the proportional valve, and a variable speed drive coupled to the controller and the motor to regulate the volume of liquid coating material delivered to the moving metal strip along with the proportional valve.
Figure 12:
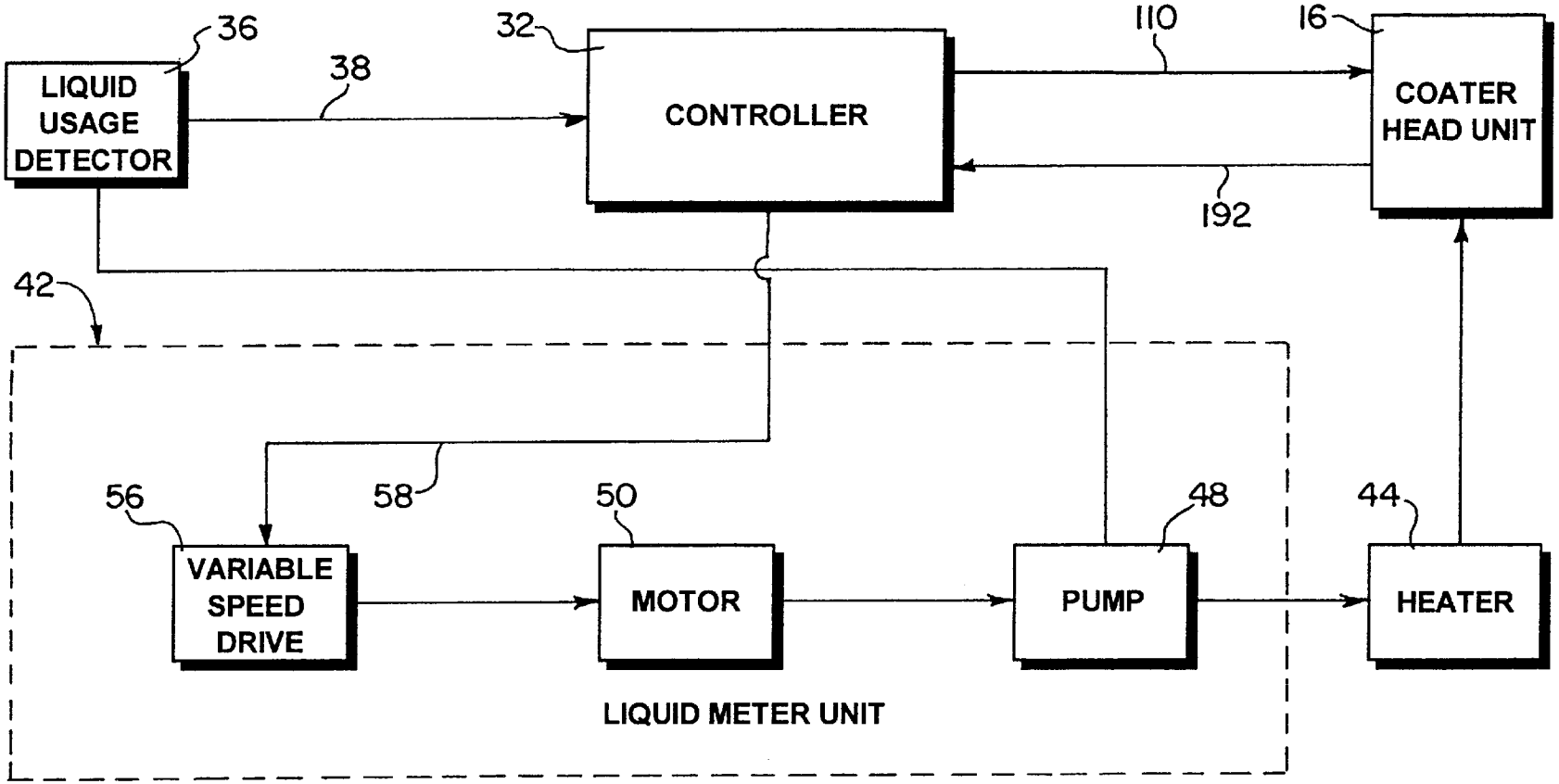
FIG. 12 is a diagrammatic view of yet another alternative embodiment of the liquid meter unit of FIG. 1 showing the liquid meter unit including the pump, the motor, and the variable speed drive without the proportional valve.

In preferred embodiments, liquid meter unit 42 includes a variable speed drive 56 in addition to or in place of proportional valve 52, as shown, for example, in FIGS. 11 and 12. Variable speed drive 56 is coupled to controller 32 and to motor 50 to regulate the volume of liquid coating material delivered to moving metal strip 12 based on a signal 58 from controller 32.

From inline heater 44, liquid coating material flows to coater head unit 16 for application to moving metal strip 12. Coater head unit 16 includes a pair of coater head movers 60, each of which is coupled to respective one of coater heads 18, 20. Each coater head mover 60 is configured to shuttle respective one of coater heads 18, 20 back and forth along a suitable foundation 194 into and out of the production line of moving metal strip 12 between an offline position spaced apart from the production line, as shown, for example, in FIG. 2, and an online position in the production line, as shown, for example, in FIG. 3. When one of coater heads 18, 20 is disposed in the online position to coat moving metal strip 12, the other of coater heads 18, 20 can be disposed in the offline position for servicing, for example, as production continues.

Figure 2:
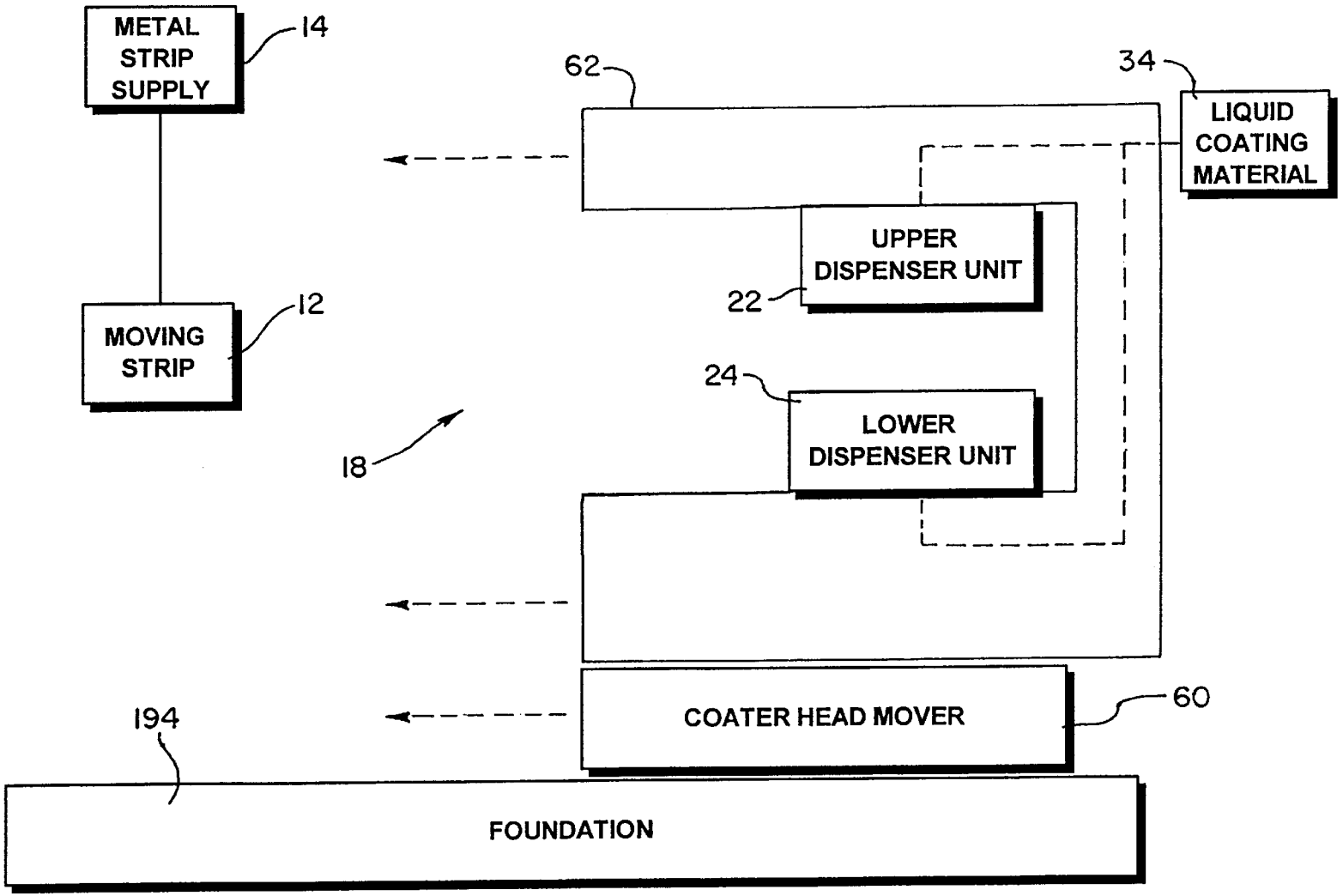
FIGS. 2 and 3 are diagrammatic views of a coater head of the coater head unit showing the coater head being movable into and out of the production line of moving metal strip between an offline position, as shown in FIG. 2, and an online position, as shown in FIG. 3, the coater head including an upper dispenser unit for applying liquid coating material to the top of the moving metal strip and a lower dispenser unit for applying liquid coating material to the bottom of the moving metal strip.
Figure 3:
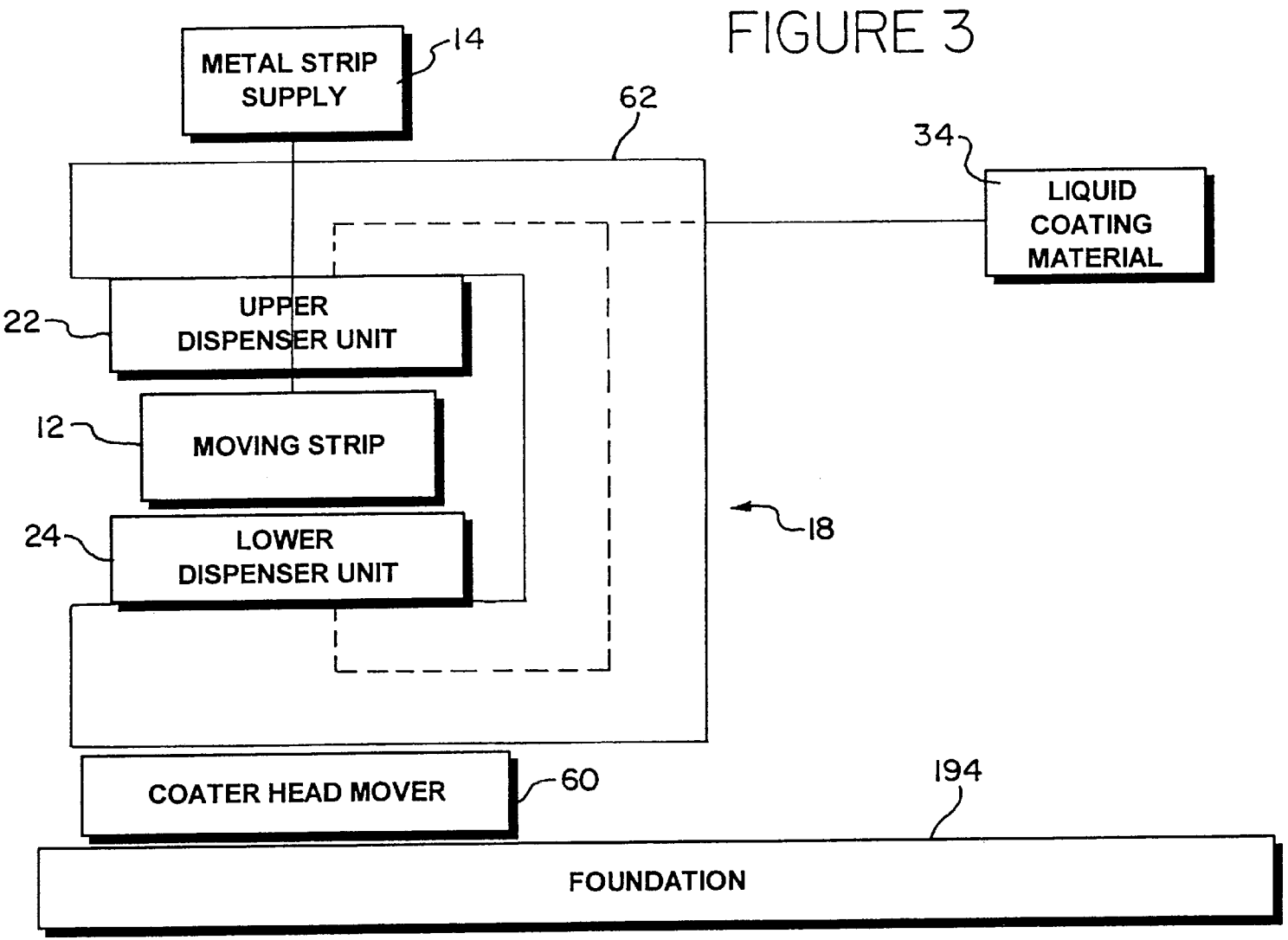
Figure 4:
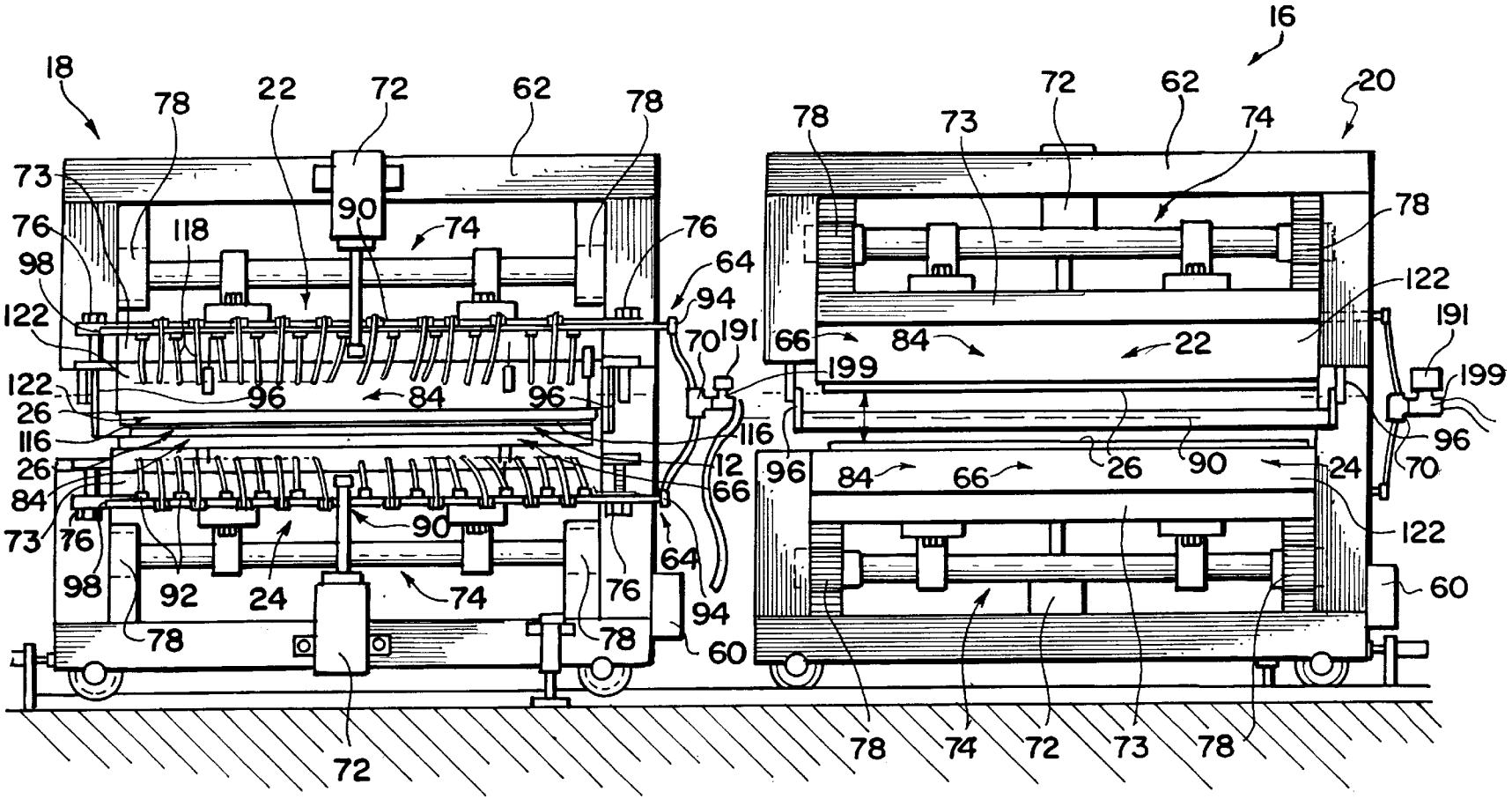
FIG. 4 is a front elevation view of the coater head unit of FIG. 1 showing the coater head unit including a front coater head (on the left side) and a rear coater head (on the right side), the moving metal strip passing between the upper and lower dispenser units of the front coater head, the rear coater head being separated from the moving metal strip.
Figure 5:
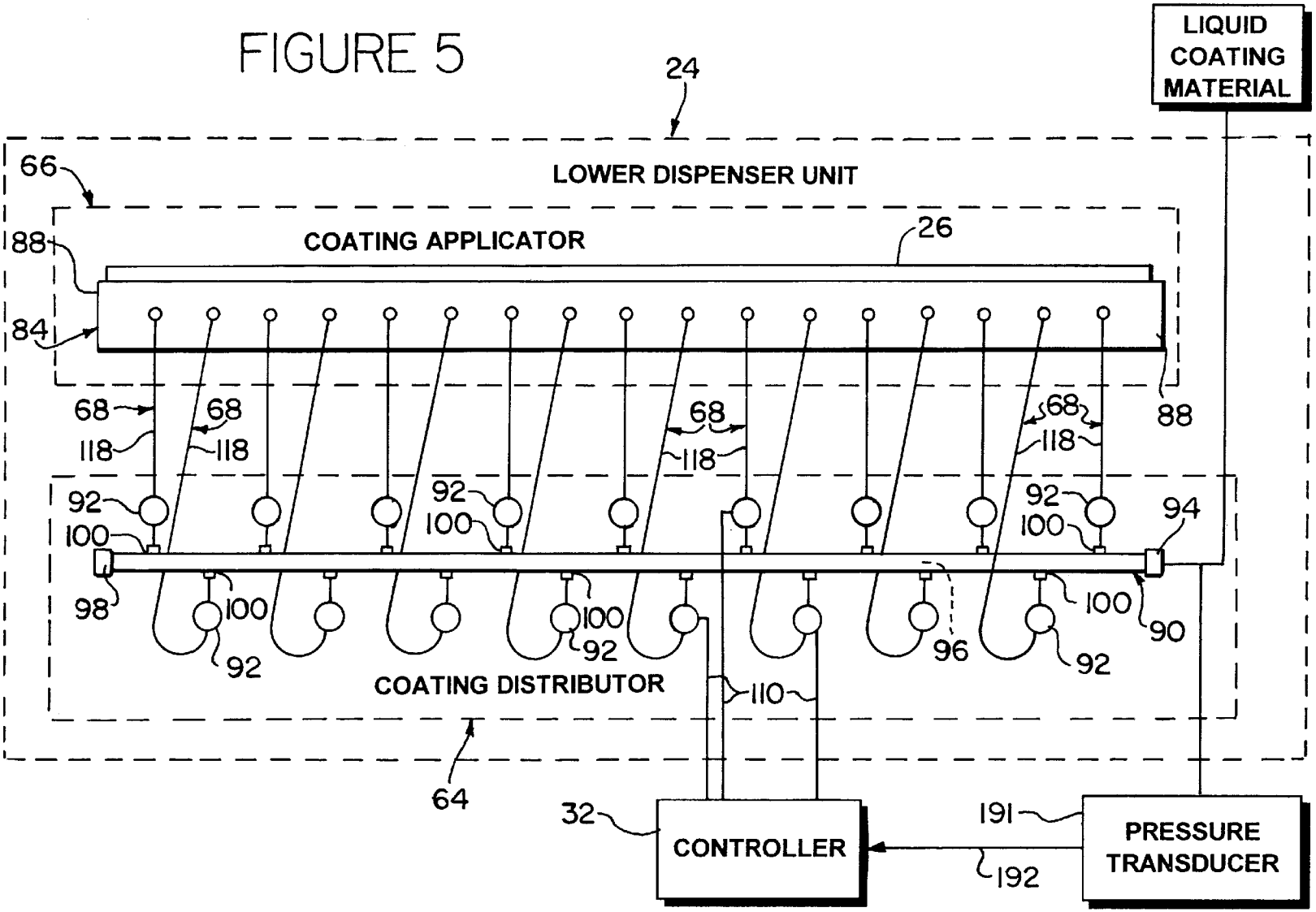
FIG. 5 is a diagrammatic view of the lower dispenser unit of FIGS. 2–4 showing the lower dispenser unit including a coating applicator to apply liquid coating material onto the moving metal strip, a coating distributor to distribute liquid coating material to the coating applicator, and liquid-conducting conduits interconnecting the coating applicator and the coating distributor, the coating applicator including a felt coating discharger made of felt material and a felt holder, the coating distributor including a manifold and a plurality of solenoid valves.

Each of coater heads 18, 20 includes a C-shaped frame 62, upper dispenser unit 22, and lower dispenser unit 24, as shown, for example, in FIGS. 2–4. Each of upper and lower dispenser units 22, 24 includes a coating distributor 64, a coating applicator, and a plurality of first conduits 68 interconnecting coating distributor 64 and coating applicator 66 for liquid communication therebetween, as shown in FIG. 5 with respect to lower dispenser unit 24, for example. Coating distributor 64 is fixed to frame 62 against movement relative to frame 62, as shown, for example, in FIG. 4. Coating applicator 66 is movable relative to frame 62 and respective distributor 64. Coating distributors 64 are configured to receive liquid coating material from inline heater 44 through a T-shaped first coupling 70 that splits the flow between upper and lower dispenser units 22, 24. Coating distributors 64 are further configured to distribute liquid coating material to respective plurality of first conduits 68, as explained in more detail below.

First conduits 68 receiving liquid coating material from respective coating distributor 64 conducts liquid coating material to respective coating applicator 66. Each coating applicator 66 is configured to receive liquid coating material from respective first conduits 68 and apply liquid coating material directly onto respective surface of moving metal strip 12 using felt coating discharger 26.

Each of coater heads 18, 20 further includes a pair of applicator movers 72, a pair of vertically movable box beams or horizontal supports 73, a pair of alignment units 74, and four mechanical stop units 76, as shown, for example, in FIG. 4. Each of applicator movers 72, alignment units 74, and mechanical stop units 76 are coupled to frame 62 and respective coating applicator 66. Each support 73 is coupled to respective applicator mover 72 and respective coating applicator 66 so that vertical movement of supports 73 by applicator movers 72 causes coating applicators 66 to move up and down between the opened and closed positions.

Controller 32 is configured to activate applicator movers 72 to move coating applicators 66 out of contact with moving metal strip 12 to "jump" splice joints (not shown) in moving metal strip 12 to avoid damage to felt coating dischargers 26. In preferred embodiments, each applicator mover 72 moves respective coating applicator 66 up and down about 4 inches.

Each alignment unit 74 cooperates with respective applicator mover 72 to ensure that felt coating discharger 26 of respective applicator 66 contacts moving metal strip 12 evenly and smoothly along the length of felt coating discharger 26. Each alignment unit 74 includes a pair of rack and pinion units 78 that maintain respective felt coating discharger 26 in parallel relation to respective surface of moving metal strip 12. Mechanical stop units 76 are configured to limit movement of respective applicator 66 toward moving metal strip 12 as respective one of coater heads 18, 20 closes to prevent damage to respective applicator 66 and moving metal strip 12.

Each of coater heads 18, 20 further includes a pair of guide units (not shown) to guide coating applicators 66 during opening and closing thereof. Each guide unit includes two sets of gibs coupled to frame 62 to form a support-receiving channel to guide respective support 73 for vertical movement during opening and closing of respective coater head 18, 20.

The structure and function of upper and lower dispenser units 22, 24 are substantially similar to one another. Thus, the following description of lower dispenser unit 24 applies to upper dispenser unit 22 and like reference numerals refer to like structures, except as otherwise noted.

Coating distributor 64 includes a manifold 90 and a plurality of solenoid valves 92 coupled to manifold 90 for liquid communication, as shown, for example, in FIG. 5. Manifold 90 is fixed to frame 62 of respective coater head 18, 20 against movement relative to frame 62. Manifold 90 receives liquid coating material from inline heater 44 and distributes liquid coating material to plurality of solenoid valves 92.

Manifold 90 is elongated and generally cylinder-shaped and includes an open, inlet end 94 which opens into a central bore 96 and an opposite, closed 98. Manifold 90 is formed to includes a plurality of outlet apertures 100. Outlet apertures 100 are spaced evenly along manifold 90 between open, inlet end 94 and opposite, closed end 98. Adjacent outlet apertures 100 are offset 180° from one another. Each of solenoid valves 92 is coupled to one of outlet apertures 100 so that each of solenoid valves 92 is in liquid communication with central bore 96 of manifold 90. Thus, liquid coating material flows from inline heater 44 in series through inlet end 94, central bore 96, and plurality of outlet apertures 100 to plurality of solenoid valves 92.

Manifold 90 is sized based on the particular application of coating apparatus 10. In preferred embodiments, there are a total of 17 outlet apertures 100 in manifold 90 of lower dispenser unit 24 and the center-lines of adjacent outlet apertures 100 are spaced four inches apart from one another.

Each of solenoid valves 92 is coupled to manifold 90 and respective first conduit 68 for liquid communication between manifold 90 and respective first conduit 68, as shown, for example, in FIG. 5. Each of solenoid valves 92 is positioned to align with respective outlet apertures 100. In preferred embodiments, solenoid valves 92 are spaced four inches apart from one another and are obtained from ASCO of Florham Park, N.J.

Solenoid valves 92 are further coupled to controller 32. Controller 32 is configured to open and close solenoid valves 92 individually by sending solenoid signals 110 to solenoid valves 92. Opened solenoid valves 92 permit liquid coating material to flow into respective first conduits 68 whereas closed solenoid valves 92 prohibit liquid coating material from flowing into respective first conduits 68.

Controller 32 determines which solenoid valves 92 to open and close based upon the position and width of moving metal strip 12. Coating apparatus 10 includes a sensor 112, as shown, for example, in FIG. 1, which is configured to detect the position and width of moving metal strip 12. Sensor 112 sends a continuous analog position/width signal 114 indicative of the position and width of moving metal strip 12 to controller 32.

In preferred embodiments, sensor 112 is a light screen system obtained from Banner Engineering Corporation of Minneapolis, Minn. Sensor 112 generates a curtain of sensing beams of light to detect the position and width of moving metal strip 12. In other preferred embodiments, sensor 112 is a steering unit used to track the position and width of moving metal strip 12 and to move respective coater head 18, 20 as required to maintain the proper location thereof with respect to moving metal strip 12.

In general, controller 32 opens those solenoid valves 92 corresponding to the part of felt coating discharger 26 between edges 116 of moving metal strip 12 and closes those solenoid valves 92 corresponding to the part of felt coating discharger 26 outside of edges 116. Controller 32 also cycles solenoid valves 92 positioned near edges 116 on and off to modulate the flow of liquid coating material near edges 116 to prevent liquid coating material from running over edges 116 and to prevent build-up of liquid coating material at edges 116. Use of proportional solenoid valves (not shown) in place of solenoid valves 92 to gain finer control of the flow of liquid coating material without valve cycling at edges 116 of moving metal strip 12 is within the scope of this disclosure.

Each of first conduits 68 is configured to conduct liquid coating material from respective solenoid valve 92 to applicator 66. Each of first conduits 68 includes a flexible tube 118 coupled to respective solenoid valve 92 and a fitting 120 coupled to flexible tube 118 and threaded to applicator 66, as shown, for example, in FIGS. 6 and 7. Flexible tubes 118 are flexible to accommodate movement of coating applicator 66 relative to coating distributor 64 as applicator mover 72 moves coating applicator 66 up and down. In preferred embodiments, flexible tubes 118 are made of translucent silicone tubing.

Coating applicator 66 includes felt coating discharger 26 and a receptacle which may be in the form of a felt holder 84, as shown, for example, in FIGS. 5–9. Felt coating discharger 26 of lower dispenser unit 24 is configured to discharge liquid coating material for application to lower surface 30 of moving metal strip 12. Felt holder 84 is configured to hold felt coating discharger 26 in place and conduct liquid coating material from first conduits 68 to felt coating discharger 26.

Figure 9:
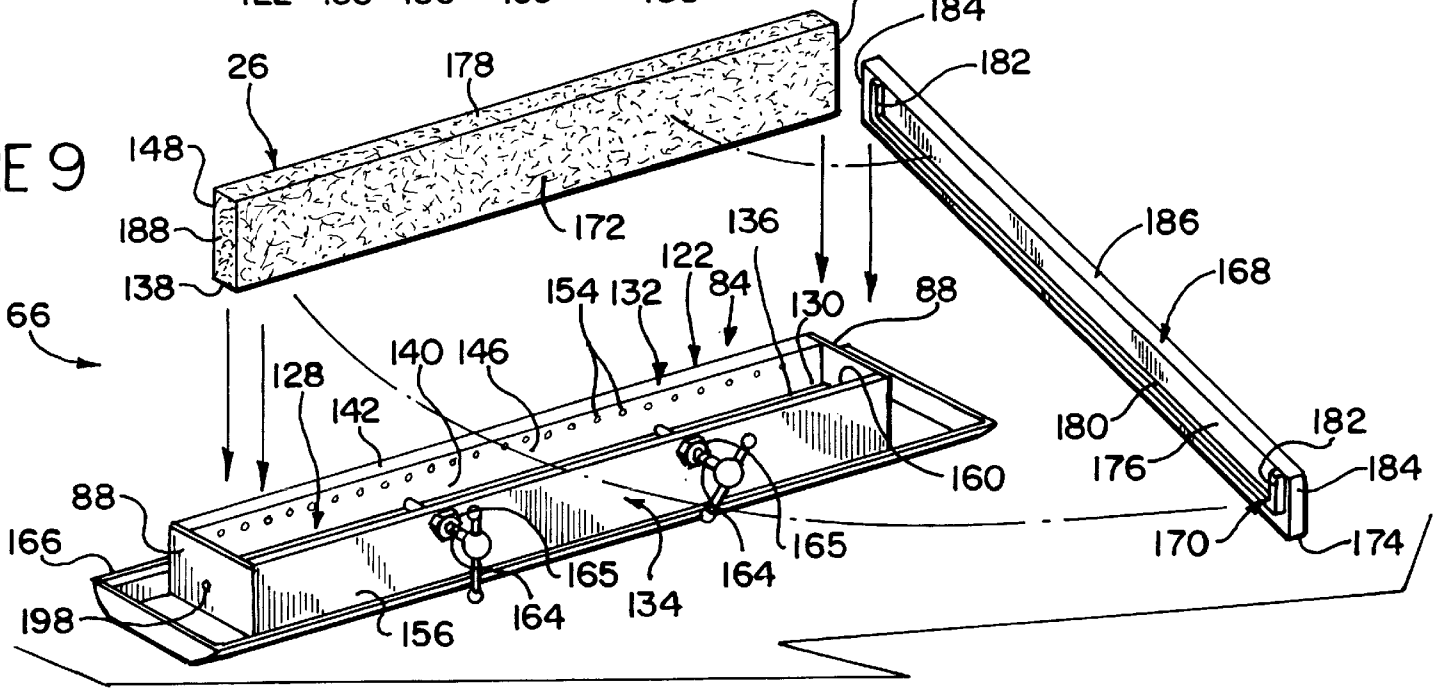
FIG. 9 is an exploded perspective view of the coating applicator of the lower dispenser unit showing the felt coating discharger sized to fit within the recessed well of the base, the base including a plurality of outlet apertures to deposit liquid coating material onto the felt coating discharger, the retainer including a retainer wall to which the U-shaped anti-wicking member is fixed and a pair of retainer arms, the retainer wall and the anti-wicking member being movable inside of the recessed well using the retainer arms to hold the felt coating discharger in place.

Felt holder 84 includes a base 122, a pair of end plates 124, and a retainer 126 movable relative to base 122 to retain felt coating discharger 26 in place, as shown, for example, in FIG. 9, and to facilitate quick and east removal of the felt coating discharger. Base 122 is U-shaped in cross-section transverse to its longitudinal extent, as shown, for example, in FIGS. 6 and 7. Each of end plates 124 is fixed to base 122 at respective end 88 of felt holder 84.

Figure 6:
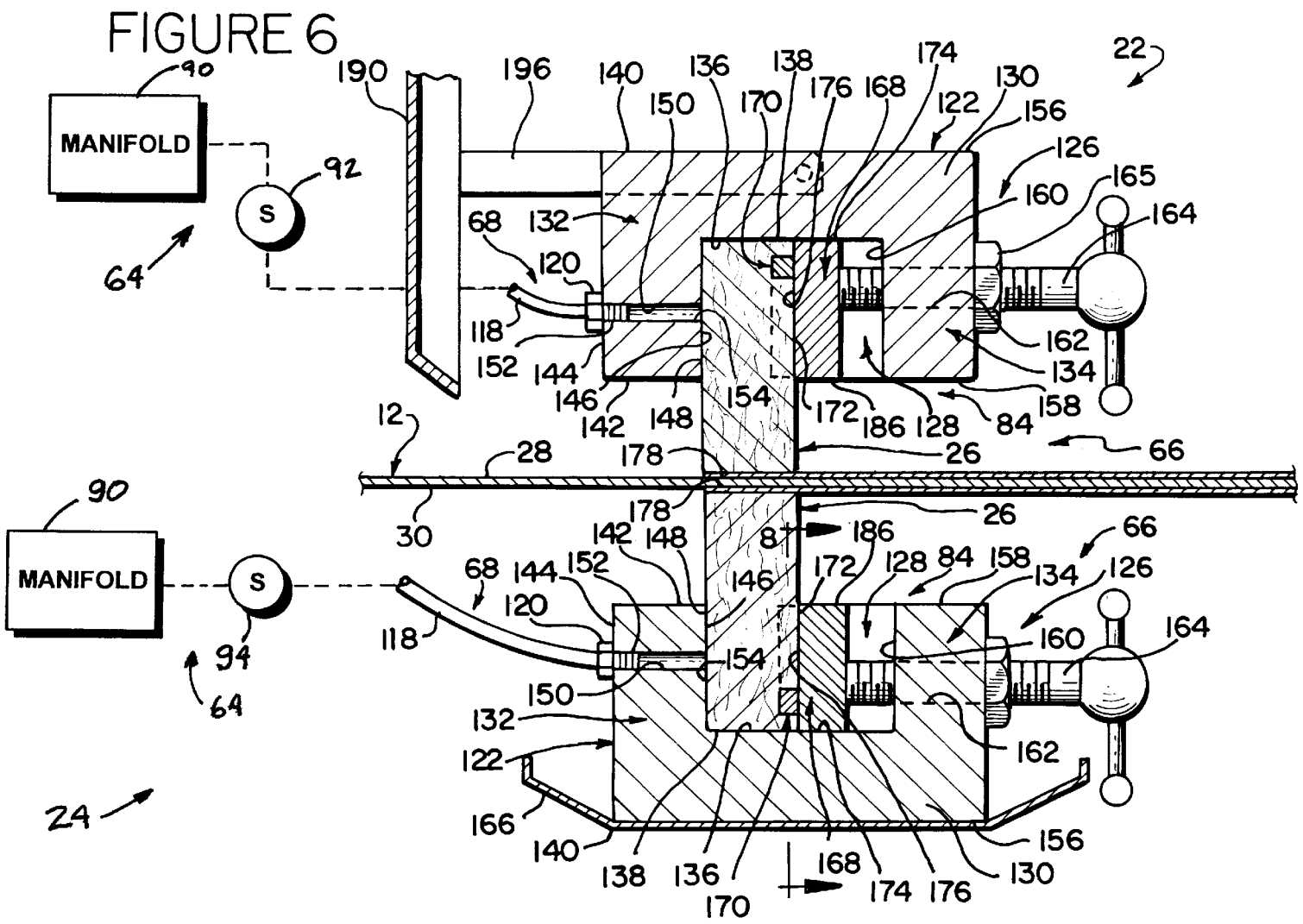
FIG. 6 is a sectional view of the upper and lower dispenser units showing the felt coating dischargers of the upper and lower dispenser units applying liquid coating material onto the moving metal strip, the felt holder including a base defining a recessed well sized to receive the felt coating discharger and a retainer movable relative to the base to retain the felt coating discharger in the recessed well, and further showing a lower drain receptacle fixed to the base of the lower dispenser unit and an upper drain receptacle pivoted out from under the felt coating discharger of the upper dispenser unit.
Figure 7:
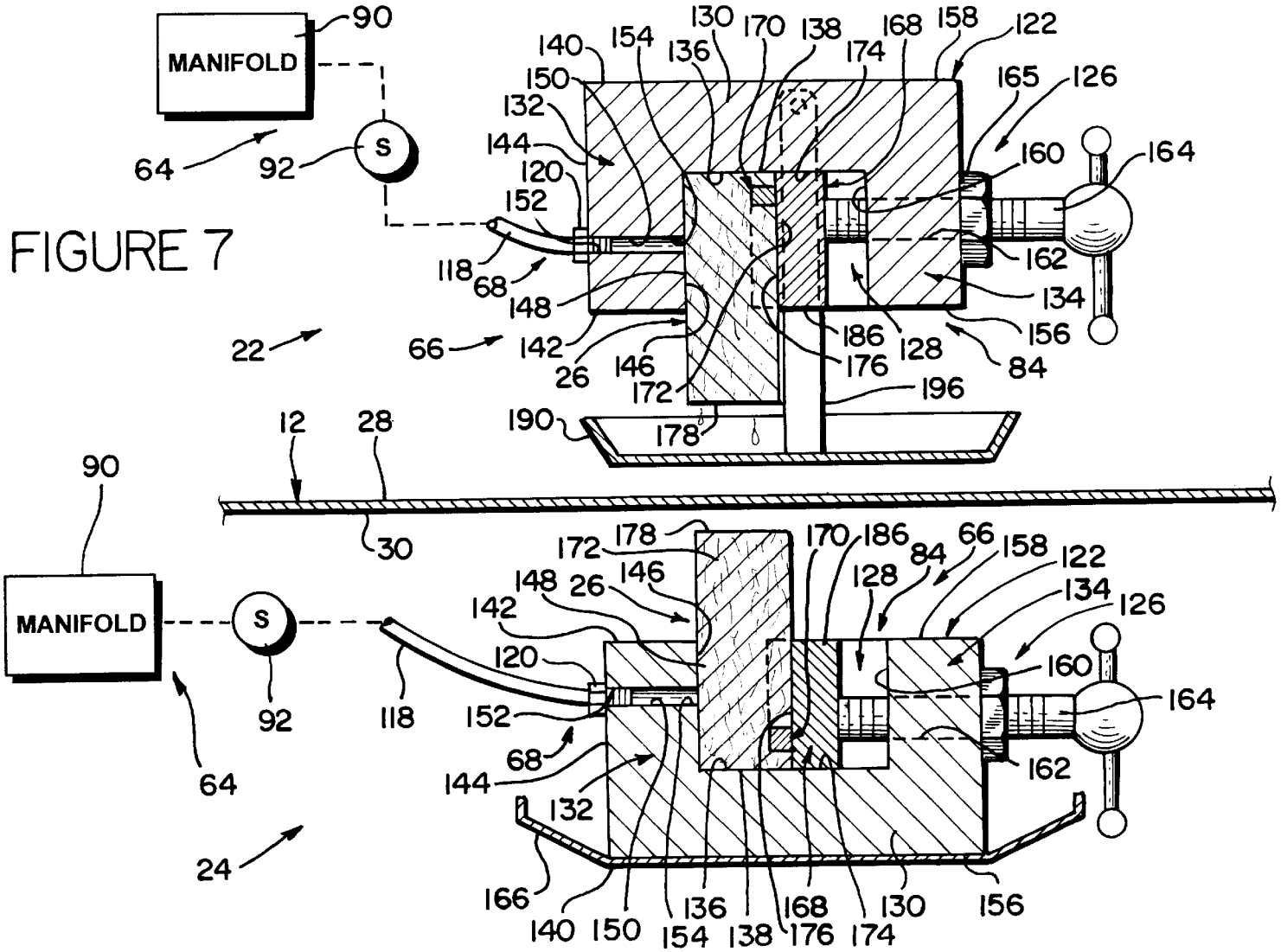
FIG. 7 is a sectional view of the upper and lower dispenser units of FIG. 6 showing the felt coating dischargers of the upper and lower dispenser units spaced apart from the moving metal strip, the upper drain receptacle now positioned under the felt coating discharger of the upper dispenser unit to catch excess liquid coating material dripping from that felt coating discharger, the lower drain receptacle also being configured to catch excess liquid coating material from the felt coating discharger of the lower dispenser unit.

Base 122 includes a horizontal wall 130, a first vertical wall 132, and a second vertical wall 134, as shown, for example, in FIGS. 6, 7, and 9. Horizontal wall 130 and first and second vertical walls 132, 134 extend longitudinally between ends 88 of felt holder 84. Horizontal wall 130 and first and second vertical walls 132, 134 cooperate to define the U-shape of base 122 and cooperate with end plates 124 to define a recessed well 128 sized to receive felt coating discharger 26. Each of end plates 124 includes a hole 198 positioned along a vertical centerline of respective end plate 124 and slightly above horizontal wall 130 to permit drainage of liquid coating material from recessed well 128, as shown, for example, in FIG. 9.

Horizontal wall 130 of base 122 includes a well surface 136. A horizontal wall-engaging surface of felt coating discharger 26 abuts well surface 136 of horizontal wall 130 inside of recessed well 128.

First vertical wall 132 of base 122 includes a proximal end 140 fixed to horizontal wall 130 and a distal end 142 spaced apart from horizontal wall 130. First vertical wall 132 extends vertically away from horizontal wall 130 toward moving metal strip 12 from proximal end 140 to distal end 142. First vertical wall 132 further includes an outer surface 144 and an inner, well surface 146 that abuts a first vertical wall-engaging surface 148 of felt coating discharger 26. Well surface 146 of first vertical wall 132 is finished so as to include serrations, raised points, and sharp, raised edges to grip felt coating discharger 26 to maintain felt coating discharger 26 in place.

First vertical wall 132 is formed to include a plurality of second or applicator conduits 150. Each of applicator conduits 150 includes an inlet 152 formed in outer surface 144 of first vertical wall 132 and an outlet 154 formed in inner, well surface 146 of first vertical wall 132. Respective fitting 120 is coupled to inlet 152 of respective applicator conduit 150 so that each of applicator conduits 150 extends from respective first conduit 68 to felt coating discharger 26 to conduct liquid coating material therebetween.

Applicator conduits 150 are positioned to lie horizontally and in parallel relation to one another. Adjacent applicator conduits 150 are spaced evenly apart from one another between ends 88 of felt holder 84 to deliver liquid coating material substantially along the length of felt coating discharger 26. In preferred embodiments, the spacing between adjacent applicator conduits 150 is four inches (10.16 centimeters), which corresponds to the spacing between adjacent outlet apertures 100 of manifold 90 and adjacent solenoid valves 92.

Second vertical wall 134 of base 122 includes a proximal end 156 fixed to horizontal wall 130 and a distal end 158 spaced apart from horizontal wall 130. Second vertical wall 134 extends vertically away from horizontal wall 130 toward moving metal strip 12 from proximal end 156 to distal end 158. Second vertical wall 134 is positioned to lie in parallel relation to first vertical wall 132 of base 122. Second vertical wall 134 includes an inner, well surface 160 positioned to lie in parallel relation to well surface 146 of first vertical wall 132. Second vertical wall 134 is formed to include a pair of passages 162 each sized to receive a separate adjustable element of retainer 126 that may be associated with the felt holder 84 in any suitable manner. The adjustable retainer element may, for example, be in the form of a retainer stem 164 of felt holder 84 that is engaged with the receptacle in any suitable manner such as, for example, a threading engagement with passage 162 and, if desired, a threading engagement with a locknut 165.

Figure 8:
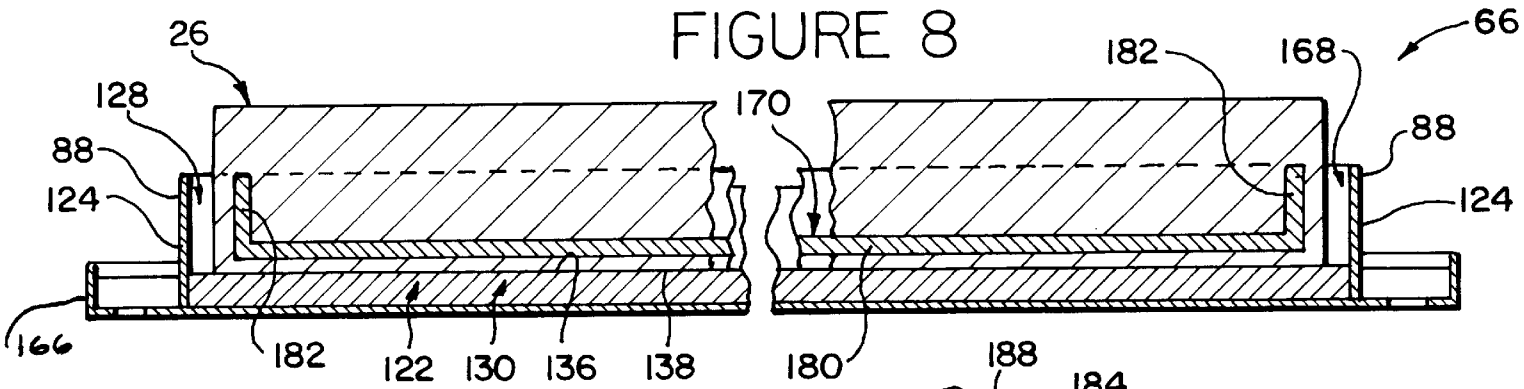
FIG. 8 is a sectional view of the coating applicator of the lower dispenser unit of FIG. 6 taken along the line 8—8 showing the retainer including a U-shaped anti-wicking member configured to press against the felt coating discharger to minimize wicking of liquid coating material away from a strip-wiping surface of the felt coating discharger.

Each of end plates 124 is positioned to lie at respective end 88 of felt holder 84, as shown, for example, in FIGS. 8 and 9. Each of end plates 124 abuts first vertical wall 132, second vertical wall 134, and horizontal wall 130 and is fixed to first and second vertical walls 132, 134. Each of end plates 124 is formed to include a drain hole (not shown) positioned near horizontal wall 130 to drain excess liquid coating material from recessed well 128 into a lower drain receptacle 166 of liquid recovery and return unit 46 fixed to base 122.

Retainer 126 includes two retainer stems 164 or other suitable adjustment elements, a retainer member which may be in the form of a retainer wall 168 associated with the retainer stems, and an anti-wicking member 170, desirably U-shaped, fixed to retainer wall 168, as shown, for example, in FIGS. 6–9. Retainer wall 168 and anti-wicking member 170 fixed thereto are positioned to lie within recessed well 128 to hold felt coating discharger 26 therein. Retainer stems 164 extend through passages or holes 162 of second vertical wall 134 into recessed well 128. Retainer stems 164 are movable back forth through passages 162 to move retainer wall 168 and anti-wicking member 170 laterally toward and away from felt coating discharger 26.

Retainer wall 168 and anti-wicking member 170 are movable laterally toward felt coating discharger 26 and first vertical wall 132 to engage a retainer-engaging lateral surface 172 of felt coating discharger 26 positioned in recessed well 128 to compress felt coating discharge between retainer wall 168, anti-wicking member 170, and well surface 146 of first vertical wall 132. In this way, felt coating discharger 26 is held in place or otherwise secured.

Retainer wall 168 and anti-wicking member 170 are movable laterally away from retainer-engaging surface 172 of felt coating discharger 26 and first vertical wall 132 to release felt coating discharger 26 to facilitate removal of felt coating discharger 26 from recessed well 128. In this way, felt coating discharger 26 can be changed quickly and easily.

Retainer wall 168 desirably is positioned to lie in parallel relation to first and second vertical walls 132, 134 and includes a bearing surface 174 and a lateral wall or holding side 176, as shown, for example, in FIGS. 6 and 7. Bearing surface 174 is positioned to slide along well surface 136 of horizontal wall 130 when retainer wall 168 is moved toward and away from felt coating discharger 26. Holding side 176 contacts retainer-engaging surface 172 of felt coating discharger 26 and is finished so as to include serrations, raised points, and sharp, raised edges to hold felt coating discharger 26 in place. Holding surface 176 is positioned to lie in parallel relation to well surfaces 146, 160 of first and second vertical walls 132, 134.

Anti-wicking member 170 is fixed to holding side 176 of retainer wall 168 and contacts retainer-engaging surface 172 of felt coating discharger 26, as shown, for example, in FIGS. 6 and 7. Anti-wicking member 170 extends away from holding side 176 of retainer wall 168 toward well surface 146 of first vertical wall 132. Anti-wicking member 170 presses against retainer-engaging surface 172 of felt coating discharger 26 along its U-shaped extent. This hinders, and desirably minimizes, wicking of liquid coating material away from an applicator surface in the form of a strip-wiping surface 178 of felt coating discharger 26 and toward first vertical wall-engaging surface 148 of felt coating discharger 26 and further minimizes wicking of liquid coating material beyond ends 188 of felt coating discharger 26.

Anti-wicking member 170 includes an elongated, proximal or horizontal portion 180 and a pair of vertical portions 182 positioned to lie in perpendicular relation to horizontal portion 180 at respective one of retainer wall ends 184, as shown, for example, in FIGS. 8 and 9. Horizontal portion 180 and vertical portions 182 are fixed to holding side 176 of retainer wall 168. Horizontal portion 180 extends longitudinally between retainer wall ends 184. Each of vertical portions 182 of anti-wicking member 170 extends vertically from horizontal portion 180 to an outer edge 186 of retainer wall 168. Desirably, the anti-wicking member 170 is positioned adjacent the proximal or bottom surface of the felt coating discharger 26, as shown for example, in FIGS. 5–7.

Anti-wicking member 170 is configured to minimize wicking of liquid coating material beyond horizontal portion 180 toward well surface 136 of horizontal wall 130 and beyond vertical portions 182. The level of applicator conduits 150 is positioned between horizontal portion 180 and strip-wiping surface 178 of felt coating discharger 26 and horizontal portion 180 is positioned between the level of applicator conduits 150 and well surface 136 of horizontal wall 130 so that wicking of liquid coating material is limited away from strip-wiping surface 178 toward well surface 136 of horizontal wall 130. Applicator conduits 150 are positioned to lie between parallel, vertical planes established by vertical portions 182 to minimize wicking of liquid coating material toward ends 188 of felt coating discharger 26.

Felt coating discharger 26 is configured to apply liquid coating material directly onto moving metal strip 12, as shown, for example, in FIGS. 6–9. Felt coating discharger 26 is inserted in recessed well 128 between first vertical wall 132, horizontal wall 130, retainer wall 168, and end plates 124. Felt coating discharger 26 receives liquid coating material from applicator conduits 150 of first vertical wall 132. Felt coating discharger 26 absorbs liquid coating material received from applicator conduits 150 and deposits liquid coating material directly onto moving metal strip 12 when moving metal strip 12 contacts felt coating discharger 26. In preferred embodiments, felt coating discharger 26 is made of F1 hard white felt material available from McMaster-Carr Supply Company located in Chicago, Ill., although other grades of felt material may be suitable for other coating applications.

Felt coating discharger 26 desirably has a generally rectangular configuration as illustrated, and includes longitudinally opposite ends 188, strip-wiping surface 178, horizontal wall-engaging surface 138, first vertical wall-engaging surface 148, and retainer-engaging surface 172, as shown, for example, in FIGS. 6–9. Surfaces extend longitudinally between ends 188 of felt coating discharger 26. First vertical wall-engaging surface 148 and retainer-engaging surface 172 extend from strip-wiping surface 178 to horizontal wall-engaging surface 138. Strip-wiping surface 178 contacts lower surface 30 of moving metal strip 12 to apply liquid coating material directly onto moving metal strip 12. Horizontal wall-engaging surface 138 abuts well surface 136 of horizontal wall 130. First vertical wall-engaging surface 148 abuts well surface 146 of first vertical wall 132 and receives liquid coating material from applicator conduits 150. Retainer-engaging surface 172 abuts holding side 176 of retainer wall 168 and anti-wicking member 170.

Upper dispenser unit 22 is similar to lower dispenser unit 24 except that upper dispenser unit 22 is inverted relative to lower dispenser unit 24 and is positioned to lie above moving metal strip 12, as shown, for example, in FIGS. 6 and 7. As a result, strip-wiping surface 178 of the felt coating discharger 26 is configured to contact upper surface 28 of moving metal strip 12.

An upper drain receptacle 190 of liquid recovery and return unit 46 is configured to catch excess liquid coating material from felt coating discharger of upper dispenser unit 22. Upper drain receptacle 190 is coupled to frame 62 through a linkage system 196.

Upper drain receptacle 190 is movable between a use position when respective coater head 18, 20 is opened and a storage position when respective coater head 18, 20 is closed. In the use position, upper drain receptacle 190 is positioned directly below felt coating discharger 26 between felt coating discharger 26 and moving metal strip 12 to catch liquid coating material dripping from upper dispenser unit 22, as shown, for example, in FIG. 7. In the storage position, upper drain receptacle 190 is positioned to the side of felt holder 84 out from under felt coating discharger 26 so that upper drain receptacle 190 does not interfere with felt coating discharger 26 as felt coating discharger 26 is moved into contact with upper surface 28 of moving metal strip 12, as shown, for example, in FIG. 6.

Lower and upper drain receptacles 166, 190 are configured to collect excess liquid coating material from coating applicators 66 so that collected excess liquid coating material can be returned to either liquid usage detector 36 or liquid supply unit 34 for reuse, as shown, for example, in FIG. 1. This helps minimize wastage of liquid coating material. In addition, drain receptacles 166, 190 allow liquid coating material to be cycled through felt coating dischargers 26 even when felt coating dischargers 26 are not coating moving metal strip 12 to prevent felt coating dischargers 26 from drying out, to allow coating apparatus 10 to be cleaned and tested, and to permit liquid coating material to be changed for another application, for example.

Each of coater heads 18, 20 further includes a pressure transducer 191, as shown, for example, in FIG. 5. Pressure transducer 191 is coupled to a T-shaped second coupling 199 coupled to first T-shaped coupling 70. Pressure transducer 191 provides a pressure transducer signal 192 indicative of this pressure information to controller 32, as shown, for example, in FIGS. 1 and 5. Controller 32 then uses this pressure information to control liquid meter unit 42 (i.e., to control the position of proportional valve 52 and/or variable speed drive 56, as the case may be).

Although the invention has been described and illustrated in detail with reference to preferred embodiments, it is to be clearly understood that the same is by way of illustration and example only, and is not to be taken by way of limitation. The spirit and scope of the present invention are to be limited only by terms of the appended claims.

What is claimed is:

1. A coater for a coater apparatus for applying coating material to a moving strip of substrate, the coater comprising a pair of dispenser units disposed about the moving strip of substrate, each dispenser unit adapted to be in communication with a supply of coating material and to apply coating material to a respective side of the moving strip, each dispenser unit comprising: a receptacle, a coating discharger strip received within the receptacle having an applicator surface for applying coating material to the respective side of the moving strip, a retainer member received within the receptacle for securing the coating discharger strip within the receptacle, and an anti-wicking member associated with the retainer member for hindering wicking of coating material away from the applicator surface of the coating discharger strip.

2. The coater of claim 1 wherein each dispenser unit further includes at least one adjustment member associated with a respective retainer member for adjustably positioning the respective retainer member within a respective receptacle.

3. The coater of claim 1 wherein each receptacle includes a pair of opposed lateral walls and a pair of opposed end walls defining an elongated well for receiving a respective coating discharger strip and a respective retainer member.

4. The coater of claim 3 wherein each dispenser unit includes at least one adjustable element comprising a stem extending through one of the opposed lateral walls of a respective receptacle for adjustably positioning the respective retainer member within the respective receptacle.

5. The coater of claim 4 wherein each stem is threadingly engaged with the respective receptacle.

6. The coater of claim 5 wherein each dispenser unit further includes a locknut threadingly engaging each stem to the respective receptacle.

7. The coater of claim 4 wherein each receptacle defines a hole receiving a respective stem, the respective stem being adjustable from outside the respective receptacle.

8. The coater of 1 wherein the coating discharger strips comprise felt.

9. A coater for a coater apparatus for applying a coating material to a moving strip of substrate, the coater comprising at least one dispenser unit adapted to be in communication with a supply of coating material and including:

(a) a receptacle having a pair of opposed lateral walls and a pair of opposed end walls defining a well;

(b) a coating discharger strip received within the well having an applicator surface for applying coating material onto the moving strip; and (c) a retaining member received within the receptacle for securing the coating discharger strip within the well; and (d) an anti-wicking member associated with the retaining member for hindering wicking of coating material away from the applicator surface of the coating discharger strip.

10. The coater of claim 9 further including at least one adjustable element for adjustably positioning the retainer member within the receptacle to secure the coating discharger strip within the well.

11. The coater of claim 10 wherein the adjustable element comprises a stem threadingly engaging the receptacle.

12. The coater of claim 11 further comprising a locknut for threadingly engaging the stem with the receptacle.

13. The coater of claim 10 wherein the coating discharger strip is disposed between and engaged with retainer member and one of the opposed lateral walls of the receptacle when the adjustable element is positioned to secure the coating discharger strip within the well.

14. The coater of claim 9 wherein the anti-wicking member is fixed to a lateral side of the retainer member.

15. The coater of 14 further including at least one adjustable element for adjustably positioning the retainer member within the receptacle to secure the coating discharger strip within the well, and wherein the anti-wicking member engages a lateral surface of the coating discharger strip to compress a portion of the coating discharger strip when the adjustable element is positioned to secure the coating discharger strip within the well.

16. The coater of claim 9 wherein one of the opposed walls of the receptacle defines a plurality of apertures for receiving a plurality of conduits in communication with the supply of coating material.

17. The coater of claim 9 wherein the retainer member includes two lateral sides and the anti-wicking member is fixed to one of the lateral sides of the retainer member.

18. The coater of claim 17 wherein the anti-wicking member is U-shaped.

19. The coater of claim 17 wherein the coating discharger strip further includes a proximal surface and a pair of opposed lateral surfaces separating the proximal surface from the applicator surface, the anti-wicking member contacting one of the opposed lateral surfaces of the coating discharger strip adjacent the proximal surface to compress a portion of the coating discharger strip when the coating discharger strip is secured within the well.

20. The coater of claim 19 wherein the anti-wicking member is U-shaped and extends along most of the length of the one opposed lateral surface of the coating discharger strip.

21. The coater of claim 9 wherein the well is elongated and the coating discharger strip and the retainer member are generally rectangular.

22. The coater of claim 21 wherein the anti-wicking member compresses a portion of the coating discharger strip when the coating discharger strip is secured within the well.

23. The coater of claim 9 comprising two dispenser units adapted to be disposed about the moving strip of substrate, each dispenser unit adapted to apply coating material to a respective side of the moving strip.

24. A coater for a coater apparatus for applying a coating material to a moving strip of substrate, the coater including at least one dispenser unit comprising:

(a) a receptacle comprising a pair of opposed lateral walls and a pair of opposed end walls defining a well, one of the lateral walls defining a plurality of passages for receiving a plurality of conduits for supplying coating material and the other of the lateral walls defining a plurality of holes;

(b) a coating discharger strip received by the well, the coating discharger strip including an applicator surface facing a distal direction, a non-applicator surface facing a proximal direction, and a pair of lateral surfaces interconnecting the applicator and non-applicator surfaces, the coating discharger strip having a generally rectangular configuration;

(c) a retainer member received by the well for securing the coating discharger strip within the well, the retainer member including a lateral retaining side, a distal side and a proximal side, the retainer member having a generally rectangular configuration;

(d) a generally U-shaped anti-wicking member fixed to the lateral retaining side of the retainer member adjacent the proximal side for hindering wicking of coating material away from the applicator surface of the coating discharger strip; and (e) a plurality of stems threadingly engaging the receptacle, the pair of stems received within the plurality of holes defined by the receptacle for adjustably positioning the retainer member within the receptacle so that the coating discharger strip is disposed between and engaged with one of the opposed lateral walls of the receptacle and the lateral retaining side of the retainer member and so that the anti-wicking guard engages a lateral surface of the coating discharger strip to compress a portion of the coating discharger strip adjacent the non-applicator surface.

25. The coater of claim 24 comprising two dispenser units adapted to be disposed about the moving strip of substrate, each dispenser unit adapted to apply coating material to a respective side of the moving strip.

* * * * *